United States Patent [19]

Pimlott

[11] 4,391,693

[45] Jul. 5, 1983

[54] CHLORINE CELL DESIGN FOR ELECTROLYTE SERIES FLOW

[75] Inventor: John R. Pimlott, Sweeny, Tex.

[73] Assignee: The Dow Chemical Company, Midland, Mich.

[21] Appl. No.: 316,265

[22] Filed: Oct. 29, 1981

[51] Int. Cl.[3] ..... C25B 9/00; C25B 15/00

[52] U.S. Cl. ..... 204/237; 204/256; 204/258; 204/266; 204/280; 204/98

[58] Field of Search ..... 204/237, 256, 258, 98, 204/128, 266, 280

[56] References Cited

U.S. PATENT DOCUMENTS

| | | | |
|---|---|---|---|
| 3,755,108 | 8/1973 | Raetzsch et al. | 204/256 X |
| 3,855,091 | 12/1974 | Piester | 204/258 X |
| 4,198,277 | 4/1980 | Kurtz et al. | 204/128 X |
| 4,279,712 | 7/1981 | Satoh et al. | 204/128 |
| 4,339,321 | 7/1982 | Kircher | 204/237 |

*Primary Examiner*—Donald R. Valentine

*Attorney, Agent, or Firm*—W. J. Lee

[57] ABSTRACT

Chlor-alkali electrolytic membrane cells are provided with means for flowing catholyte from cell-to-cell sequentially, and means for flowing anolyte from cell-to-cell sequentially.

12 Claims, 8 Drawing Figures

CHLORINE CELL DESIGN FOR ELECTROLYTE SERIES FLOW

BACKGROUND OF THE INVENTION

In U.S. Pat. Nos. 4,197,179 and 4,269,675, there is disclosed a method and means for operating a plurality of chlor-alkali membrane cells by flowing catholyte from cell-to-cell sequentially while countercurrently flowing anolyte from cell-to-cell sequentially.

U.S. Pat. No. 4,057,474 discloses a bank of cationic permselective membrane cells operated with series (cell-to-cell) flow of the catholyte. The cell is illustrated as having flat monopolar electrodes.

Other patents which disclose electrolyte series flow are: U.S. Pat. No. 1,284,618; U.S. Pat. No. 3,899,403; and German No. 24 37 783.

It is an object of the present invention to provide electrolyte series flow in banks of membrane cells, especially those of bipolar electric conduction.

A further object is to provide electrolyte series flow in such membrane cells wherein the electrolyte flow from cell-to-cell is taken from a level above or near the tops of the electrodes of one cell and introduced to a level below the tops of the electrodes in the next cell in sequence.

A still further object is to provide electrolyte series flow in such cells by taking the electrolyte from degassing compartments located atop the cells and introducing the electrolyte to the next succeeding cell at a location which is preferably below the top of the electrodes.

Yet another object is to provide novel degassing compartments for installation atop specially designed cell banks, the de-gassing compartments containing means for causing electrolyte from a given cell to flow through down-comers in the next succeeding cell in the bank, the gases in the de-gassing compartments being preferably removed cumulatively.

These and other objects will be apparent to practitioners of the relevant arts from this disclosure.

SUMMARY OF THE INVENTION

Banks or series of chlor-alkali membrane cells are provided with means for flowing electrolyte from cell-to-cell in a manner such that electrolyte from a cell is taken from a point near the top or above the vertical electrodes in the cell and introduced to the corresponding electrolyte section in the next succeeding cell, preferably at a location below the top of the electrodes, the last cell of the series having flow means for removing the electrolyte to its subsequent destination.

Drawings are provided as visual aids for describing embodiments of the present invention. The drawings are not to scale, are not all in complete detail, and are only representative of the various alternate embodiments which become apparent to practioners of the relevant arts once they have read this disclosure.

A complete explanation of FIGS. 1–7 is provided hereinafter.

DETAILED DESCRIPTION OF THE INVENTION

The banks (or series) of cells useful in the present invention are defined as monopolar or bipolar chlor-alkali membrane cells having vertically-disposed anodes and cathodes, wherein the electrodes are of a pocket or flat plate design, separated by a membrane. The membranes are cationic permselective and are substantially hydraulically-impermeable. The cells, when installed as a bank of cells, are preferably "bipolar" in that electrical current flow occurs through conductors which are connected to the anodes of one cell and to the cathodes of the next adjacent cell, such as in U.S. Pat. No. 2,282,058. In a preferred embodiment there is a space between the anode-plate and the electrically-conjoined cathode-plate wherein the bipolar coupling is made, said space serving as part of the catholyte compartment similar to U.S. Pat. No. 2,282,058. The space within each of the pocket-cathodes communicates (through ports in the cathode-plate) with the catholyte compartment and is, therefore, a part of the catholyte compartment. Electrochemical current flow is from the cathode, by way of the bipolar electric coupling to the anode of the next adjacent cell and so on until the circuitry is completed by current flow from the last cathode or cathode-plate in the bank of cells.

The bank or series of cells may comprise any plural number of cells when the bipolar method of conducting electric current from cell-to-cell is used. The practical limit to the number of cells in a series is decided more by frictional factors (pressure drop) of the electrolyte liquors and by the practical volumetric limit of the flow means required to handle the quantity of liquors, than by the electrical considerations. A practical range is usually from 2 to about 10 cells in a series, with 3 to 7 being preferred. Most preferably, a series of 5 cells is employed. Preferably, the series flow (also sometimes called a "cascade" flow) involves flowing both the anolyte and the catholyte, especially when such simultaneous series flows are done counter-currently.

Figure 1:
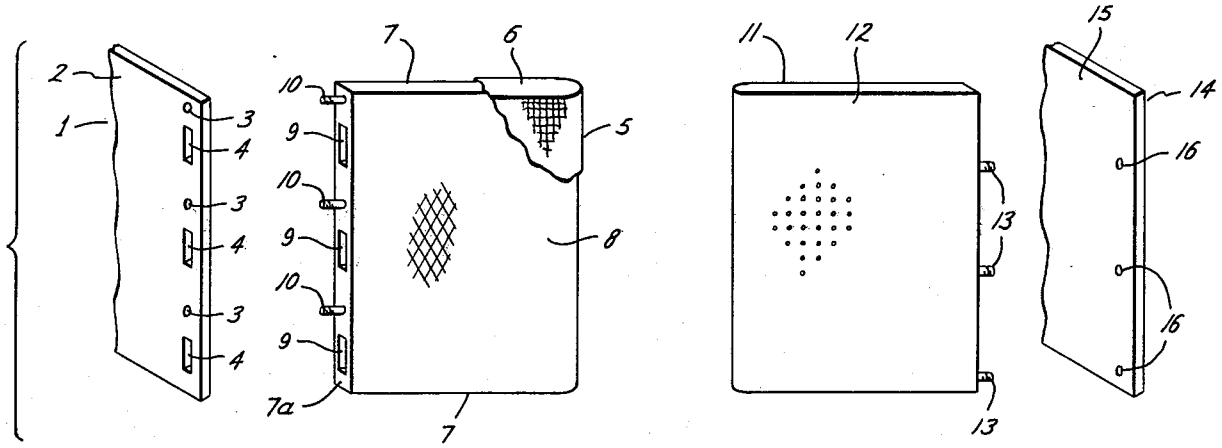
FIG. 1 illustrates an exploded view (not to scale) of a cathode-plate (1), a membrane-covered foraminous cathode (5), a metal anode (11), and an anode plate (14).

FIG. 1 illustrates an exploded view to demonstrate generally a cathode-plate (1), a pocket-cathode (5), an anode 11, and an anode-plate (14). The cathode-plate (1) is shown as a metal plate (2) having sufficient thickness or construction to remain rigid in service, through which there are bolt holes (3) and ports (4). The pocket-cathode (5) is shown as a foraminous metal (8) which is bent or folded back to form two substantially parallel sides, the top end and bottom end being closed by metal portions (7) which may also be foraminous, the remaining side (or edge) being closed by a rigid member (7*a*) to which is connected bolts (10) and through which there are ports (9) to permit liquid flow to and from the inner space of pocket-cathode (5). The cathode ports (9) are aligned with cathode-plate ports (4) when bolts (10) are positioned in bolt holes (3) when assembled. A membrane (6) completely covers cathode (5), except for (7*a*) and there is normally little or no space between membrane (6) and foraminous metal (8), depending on how tightly the membrane is installed and, at times, depending on whether the membrane stretches or shrinks during handling, storage, or operation; complete (tight) blinding of the external surface of foraminous metal (8) by the membrane (6) is not generally recommended. The cathode configuration, often referred to as pocket-type or pocket-shape, is one in which the space within the cathode communicates only with the catholyte; communication of liquid water with anolyte is substantially prevented by the substantially hydraulically-impermeable membrane which covers the cathode on all sides except the side (or edge) which is attached to the cathode plate. The number of bolts (10) and ports (9) in the cathode construction is not especially critical except of course there is to be a matching number of holes (3) and ports (4) in cathode-plate (1).

Also in FIG. 1 there is illustrated an anode (11) which comprises, preferably, a foraminous metal sheet (12) bent or folded back to form substantially parallel sides, usually leaving the upper edge and lower edge open. The edge opposite the bent edge may be closed by a metal strip to which are attached bolt means (13). The bolt means (13) are aligned (when assembled) with bolt holes (16) in metal plate (15) which comprises anode plate (14). Alternatively, the anode may be a sheet or slab which is solid or foraminous, instead of the folded back design shown.

The cathodes (5) and anodes (11) are not required to be prepared by bending or folding a single sheet of metal back to form parallel sides, since one may also form the two sides by welding or otherwise fastening two sheets of metal to edge pieces to form the desired shape. Generally, however, the bend-back or fold-back method is preferable.

Figure 2:
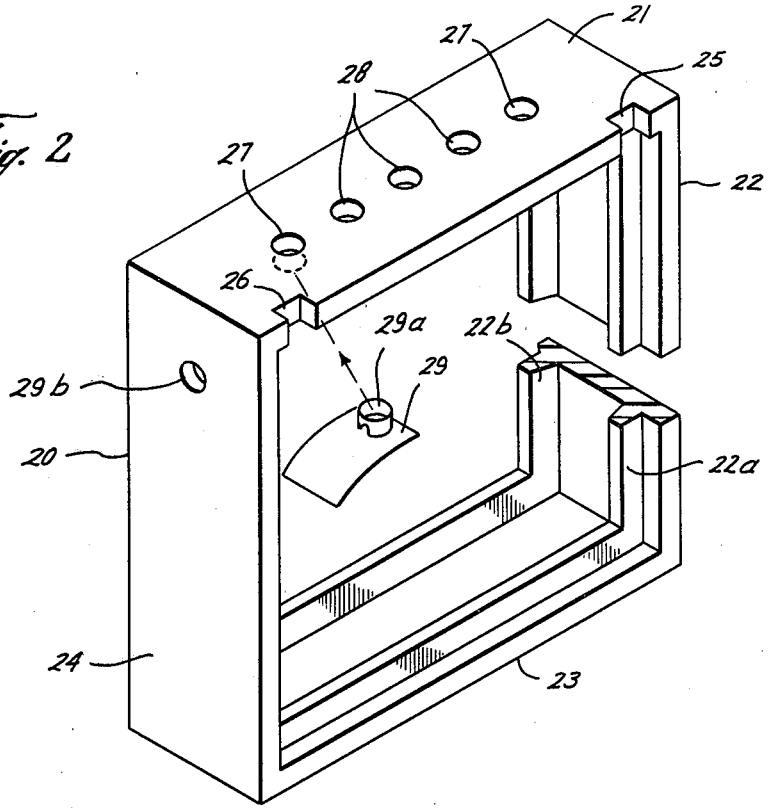
FIG. 2 illustrates an isometric view of a cell frame embodiment (not to scale) useful in constructing bipolar membrane cells for use in the present invention.

FIG. 2 illustrates a cell-frame (20), not to scale, having a top-side (21), a first vertical side (24), a second vertical side (22) and a bottom side (23). A portion of side (22) is cut-away to reveal a cross-sectional view of ridges (22*a*) and (22*b*) which protrude from the inner surfaces of all four sides. The purpose and relatively of ridges (22*a*) and (22*b*) are made more apparent in FIG. 3, described hereinafter. In top side (21) there are two ports (27) for flow of degassed anolyte to downcomers (29). Between ports (27) there is at least one port (28) for anolyte (with gas) to flow upwardly (such as by gas-lift and/or mass flow) from the anolyte space within cell-frame (20). When the cells are assembled and in operation the anolyte with gas flow up through ports (28) is diverted to a next adjacent cell where it is degassed and then flows back downwardly through downcomer ports (27) where the anolyte flow is channeled down the outer portion of the next anolyte chamber by the action of flow downcomers (29). Flow downcomers (29) are illustrated in FIG. 2 in an "exploded" view, only one such diverter being shown, although it is easily recognized that there is, preferably, a downcomer (29) for each downcomer hole (27). When assembled in place, the downcomer (29) is positioned to communicate directly with hole or port (27) by means of, e.g., an attachment or insert piece (29*a*), causing the anolyte to flow downwardly between the ridges (22*a*) and (22*b*) to a point below the upper portion of the anolyte space within cell-frame (20). Other configurations for the downcomers may be employed and, in fact, it is possible to build downcomers directly into the cell-frame. Ports (25) and (26) serve as catholyte flow means whereby catholyte flow travels from cell-to-cell by gravity flow down one port, say (25) in a given cell frame and by gas-lift back up the opposite port, say (26) of the same cell frame, where it then flows back down through a corresponding catholyte flow port of the next cell frame in the series. The majority of the liquor carried up into the covers by gas (50 and 51 of FIG. 6) through slots (25 and 26) is returned to the catholyte compartments through slots (25 and 26), the flow being separated by weir-baffles (see 85 of FIG. 7). It is to be understood, of course, that the electrolyte flow to the first cell of a bank or series is from an external source and that the electrolyte flow from the last cell of a bank or series is taken from the series for further handling, but that the electrolyte flow within the series is from cell-to-cell. Side ports (29*b*) may be used when frame (20) is used as in FIG. 4.

Figure 6:
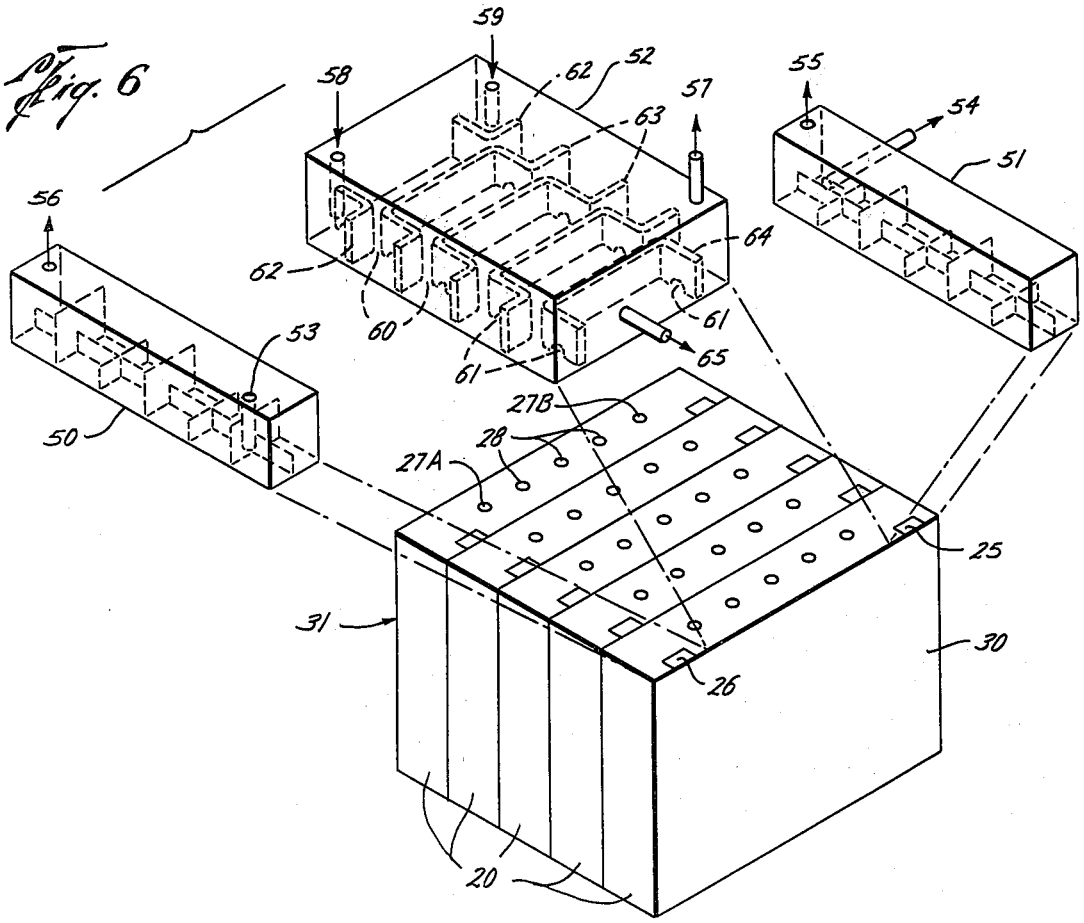
FIG. 6 illustrates a generalized view of five cells arranged in filter-press manner with the cell cover compartments shown in an exploded manner.
Figure 7:
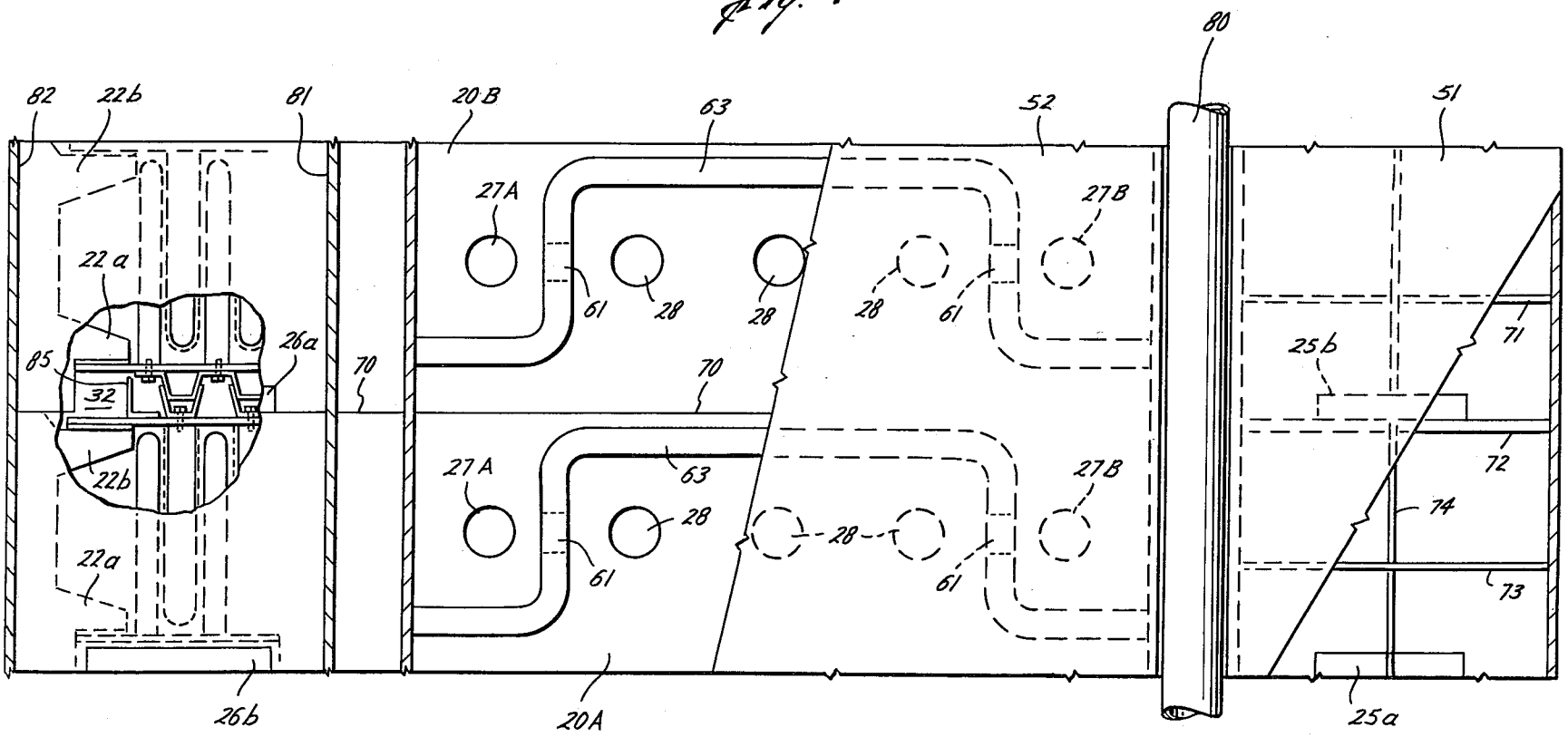
FIG. 7 illustrates a partial view of a cell to demonstrate the relative positioning of cell cover compartments such as shown in FIG. 6.

In order to readily accomodate the cell covers shown in FIG. 6 and FIG. 7, it is preferred in FIG. 2, that anolyte ports (27) be located closer to the middle of top side (21) than the catholyte ports (25 and 26), substantially in a manner as shown in FIG. 2 and FIG. 7.

Figure 3:
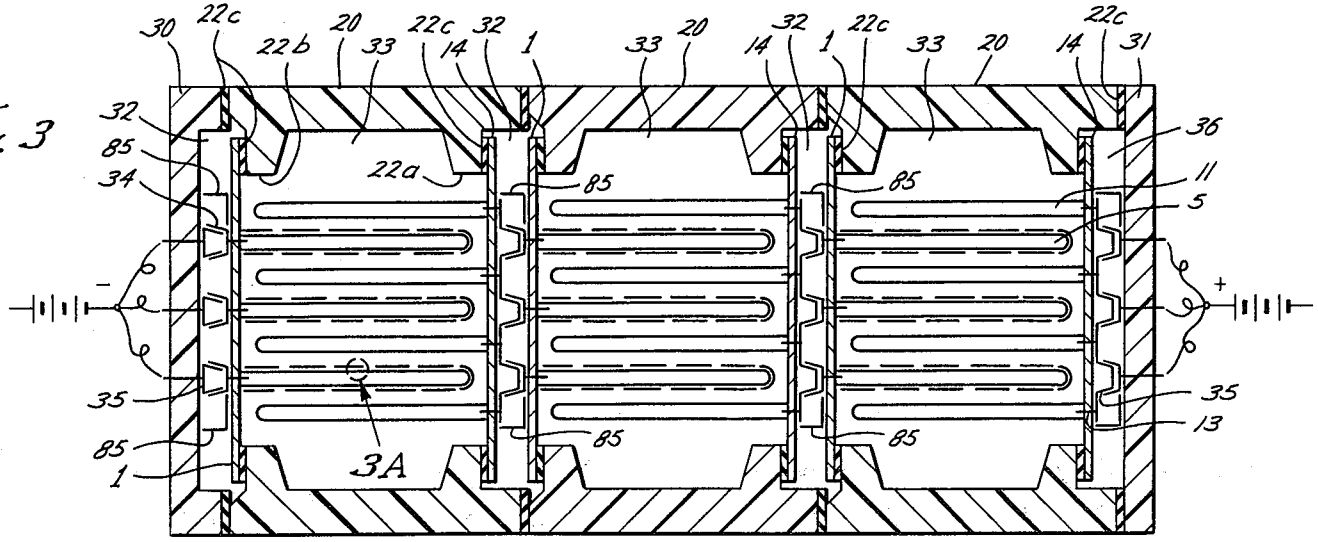
FIG. 3 illustrates a top view (cross-section) of an embodiment (not to scale) comprising three cells arranged in a "filter-press" type of arrangement with bipolar conduction of electricity through the cells.

With reference to FIG. 3 there is illustrated a series of three cell-frames (20), viewed in cross-section from the top. Within each cell-frame (20) there are mounted a plurality (only 4 are shown in each frame) of anodes (11) interleaved from opposite directions with a plurality (only 3 are shown in each frame) of membrane-covered cathodes (5). The cathodes (5) are assembled into place and supported by cathode-plates (1). The anodes (11) are assembled into place and supported by anode-plates (14). The means for attaching anodes and cathodes to their respective plates are, e.g., the bolt-means shown in FIG. 1. Electrical circuitry is provided by attaching the electrode bolt-means to conductive couplings (preferably copper couplings) substantially as illustrated. The coupling of cathodes of one frame to the anodes of another frame carries the electric current from frame-to-frame. In operation of the embodiment shown in FIG. 3, anolyte is in anolyte portions (33) and catholyte is in catholyte portions (32) as well as within the pocket cathodes (5) which communicate, via ports within cathode-plates (1) to said catholyte portions (32), substantially as illustrated in FIG. 1. The cathode-plates (1) are tightly sealed in place against ridges (22*b*) to avoid mingling of anolyte and catholyte, while anode-plates (14) are sealed in place against ridges (22*a*) for the same purpose. The seal (or gasket) (22*c*) may be an inert rubber, plastic, or mastic, preferably one which is substantially inert and long-lived in the cell environment and conditions. The series of cell-frames (20) are usually sealed at their conjoined faces and tightly squeezed together by a bolt-means or clamp-means (not shown) to avoid leakage from the joints. Squeezing together of the cell-frames also squeezes together the conductive couplings (e.g. 34 and 35). Area (36) is dead-space, housing only the conductive couplings carrying electric current to the first set of anodes. End section (30) is a cathode buss-plate and end section (31) is an anode buss-plate. In FIG. 3, the cathode-plate (1) has optionally, but preferably, a vertically-mounted baffle of flow-divider (85) which is affixed to the plate at a position outside the end cathode at each end; this flow-divider (85) extends above the cathode-plate so that when mounted in a cell-frame of FIG. 2, the flow-divider (85) splits ports (25) and (26) into two portions.

Figure 3A:
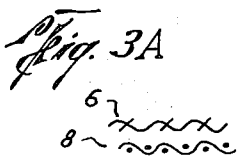
FIG. 3A illustrates an enlarged cross-sectional view of a small portion of cathode of inset area of 3A in FIG. 3 to show a foraminous cathode screen covered with a membrane.

FIG. 3A is an enlarged view of inset area 3A shown in FIG. 3 to illustrate a membrane (6) on a foraminous metal screen (8); in this case it is shown as a woven wire screen, but may also be a punched-plate or expanded slit plate, all of which are known in the art.

Figure 4:
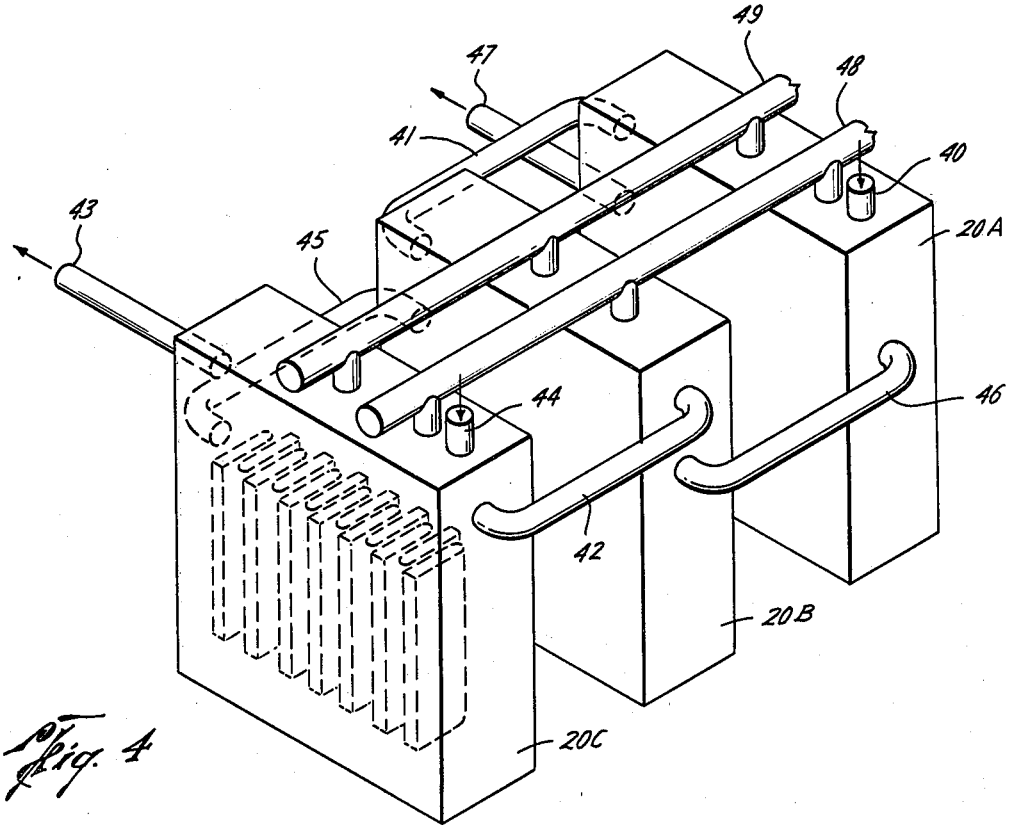
FIG. 4 illustrates three cells connected by flow means for accomplishing cell-to-cell flow of electrolytes.

FIG. 4 is an illustration to show cell-to-cell flow, countercurrently, of anolyte and catholyte in an alternate embodiment. It illustrates that anolyte or brine is fed through conduit (40) into the top (or near the top) of the anolyte portion of cell-frame (20A) and flows from cell (20A) to cell (20B) through flow means (41), then from cell (20B) to cell (20C) through flow-means (42), then from cell (20C) through flow means (43). The catholyte flows countercurrently to anolyte, by entering cell (20C) as catholyte or water at flow means (44) which is at or near the top of the catholyte portion of cell (20C), then flows from cell (20C) to cell (20B) through flow means (45), then from cell (20B) to cell (20A) through flow means (46), then from (20A) through flow means (47). It will be understood, of course, that in each cell-frame the anolyte portions are separated from the catholyte portions by a substantially hydraulically-impermeable membrane.

The cells illustrated in FIG. 4 may be of the monopolar type or may be of the bipolar type. The cells in FIG. 4 need not be spread apart as illustrated, but may be closely pressed one against another such as in FIG. 3, especially when bipolar series electrical circuitry is desired. Cell gases from the anolyte portions are collected in a header (48) and cell gases from the catholyte portions are collected in a header (49). The levels of anolyte and catholyte in the FIG. 4 cells are controlled somewhat by the flow rates, but primarily by the locations of the flow means which carry them to and from each cell, the separations of cell gases (de-frothing) in each cell being permitted by the head space above the electrolytes in each cell.

Figure 5:
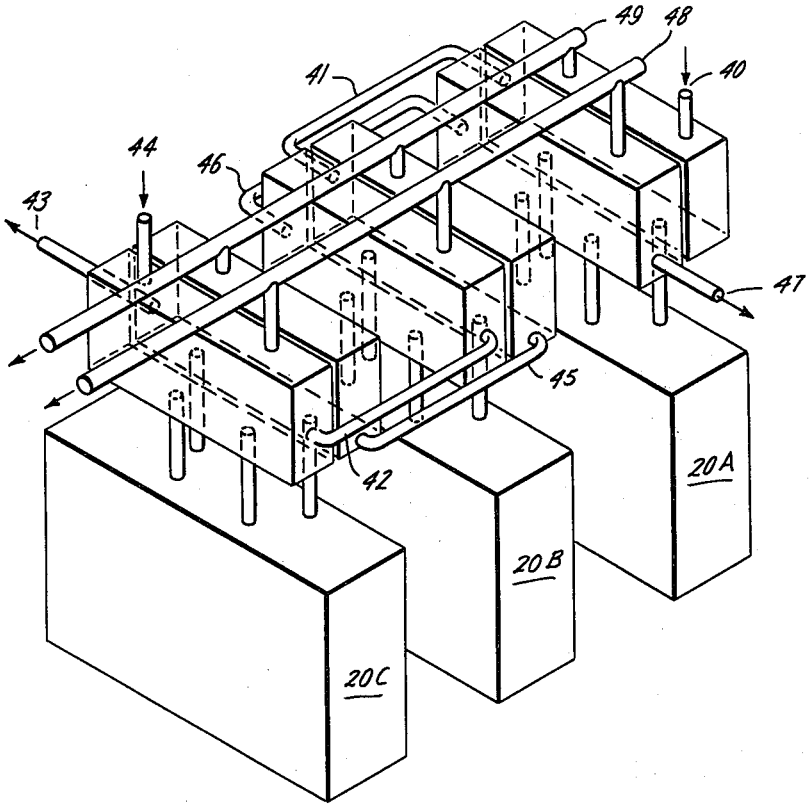
FIG. 5 illustrates three cells arranged in a manner somewhat similar to FIG. 4 but the compartments for separating cell-gases from electrolyte are elevated above the cells.

FIG. 5 illustrates an alternate embodiment of a kind of flow arrangement similar to that shown in FIG. 4, except that the separations of cell gases from the electrolytes in each cell are accomplished in separate compartments mounted atop the cells. Electrolytes are conveyed to the respective compartments through conduits from the anolyte portions and the catholyte portions.

FIG. 6 is an exploded view of a series of five cell-frames (20) arranged in bipolar, "filter-press" manner in order to demonstrate cooperation with novel cell covers. The cell-frames (20) are of the type such as illustrated in FIG. 2, the bipolar filter-press arrangement being substantially as shown in FIG. 3. When assembled, catholyte cell covers (50) and (51) are conveniently arranged, respectively, to communicate with the top of a near-side of the cell series (shown here as 5 cells), and with the top of the corresponding opposed far-side of the cell-series. The covers are substantially open on the underside, having the general appearance of inverted closed-end troughs. Within cover (50) there is shown a series of "tall" spaced-apart upright baffles separated by spaces which each contain a "short" weir-type baffle. Running lengthwise (and about mid-wise) of cover (50) there is a "short" baffle which is not only a part of the catholyte flow directors, but may also serve beneficially as a strengthening means for the "tall" and "short" baffle means. Cover (51) is quite similar to cover (50), but the baffle arrangements are different; in cover (51) there is a series of "short" baffles separated by spaces which each have a "tall" baffle. Thus where cover (51) has a "tall" baffle, the corresponding baffle directly across from it in cover (50) is a "short" baffle. Anolyte-cover (52) has the general appearance of an inverted trough, but is shown here as being wider than catholyte-cover (50) or (51); it is designed in this illustration with appropriate baffles to serve the five cells (20). When assembled onto the cell-series, covers (50), (51), and (52) are sealed by use of gasketing, mastic, "cell-putty" or other appropriate sealing means to avoid leakage of electrolytes from under the covers to outside the cells. The ends of the cell series are "capped" by buss-plates (30) and (31) such as illustrated in FIG. 3, cathode buss-plate (30) serving as a wall portion of an end catholyte-portion, and anode buss-plate (31) serving as a wall portion for the opposite end. Electrical circuitry is provided for the cell-series of FIG. 6 substantially in accordance with that shown in FIG. 3.

When assembled, charged with appropriate electrolytes, and in operation, catholyte or water flow in the cell-series of FIG. 6 is conducted through inlet flow means (53) into the first baffled section of cover (50) from where it enters the first catholyte portion through port (26). Because it cannot flow over the tall baffle, the catholyte flow from the said first catholyte portion is forced up through port (25) into cover (51) where the catholyte flows over the "short" weir-type baffle and back down into the second catholyte portion. From the second catholyte portion the liquor flows up into cover (50) into the second baffled section, then across the "short" weir-type baffle to the third catholyte portion and so on, up, across, and down between covers (50) and (51) through cells (20) until it reaches the end of its journey and flows out of flow means (54) from cover (51). Catholyte flow means (54) may be fitted with an adjustable leg so that the catholyte level may be adjusted above or below the anolyte level in cover (52) as the operating conditions require. The anolyte level in cover (52) may also be raised or lowered by use of an adjustable leg at outlet flow means (65). At the same time, anolyte flows countercurrently to the catholyte flow in the cell-series, by being conducted as brine or anolyte through inlet flow means (58) and (59) which communicate with anolyte ports (27A) and (27B) in the cell which is the "last" cell with respect to catholyte flow, but which is the "first" cell with respect to the anolyte flow. The anolyte in the first anolyte portion is forced up into cover (52) through anolyte ports (28) and is directed by baffling to corresponding ports (27A) and (27B) into the second anolyte portions. In each of the anolyte portions there are, preferably, downcomers such as shown in FIG. 2 to cause the anolyte liquor to merge with the anolyte in the cell at a point below the surface of the anolyte, preferably near the bottom of the anolyte portion. The anolyte cover (52) contains corner baffles (62) to form a compartment for each of flow means (58) and (59), the area between the two corner baffles defining a space communicating with the first set of anolyte ports (28). It is not essential that there be more than one downcomer hole in each anolyte portion, but better anolyte mixing and circulation within each anolyte portion is achieved by having more than one downcomer hole, especially if they are oppositely disposed from each other. The anolyte flowing from upcomer holes (28) is directed by baffling means (63) to the downcomer holes in the next adjacent cell through openings (60) between the baffles, this manner of anolyte flow proceeding through the cell-series until the anolyte from the final set of upcomer holes (28) flows out through flow means (65). The exact configuration of baffles (63) is not critical, so long as the baffling causes flow of anolyte from upcomer holes in one cell to the downcomer holes in the next cell, except of course, when the anolyte flow is removed from the last set of upcomer holes. The baffles (63) are solidly connected to the inner surfaces of the side walls of cover (52), but there is a common head space for cell gases above the baffles within the anolyte cover; cell gases can exit through vent means (57) to a collector. Only one such vent means (57) is shown, but it is within the purview of this invention to have more than one such vent in each anolyte cover. Vent means (55) and (56) are also provided in the catholyte covers to remove catholyte cell gases to a collector. The "depleted" anolyte from flow means (65) in anolyte cover (52) may be, if desired, re-strengthened with alkali metal halide (e.g. NaCl) and recirculated, along with any desired make-up anolyte, back to a cell series. In the baffle means (63) and (64) in anolyte cover (52) there are small openings (61) at the bottom near the downcomer holes to permit some mixing of anolyte in the downcomer area and upcomer area of a given cell. These small holes (61) recirculate the excess anolyte carried up into cover (52) by gas-lift, thus offsetting any tendency for the gas-lift to "pump-down" the anolyte level within cell (20).

FIG. 7 depicts a top view of a portion of a cell-series, not to scale, with cut-away portions, to illustrate the approximate position of the catholyte covers and anolyte cover of FIG. 6. There are major portions of two cell frames (20A) and (20B) tightly abutted along line (70). On one side there is shown a portion of catholyte cover (51), a portion of which is cut-away to reveal baffles therein and to reveal a catholyte port (25*a*) which is in the top of frame (20A). The baffles in the illustrated portion of cover (51) may, depending on which part of the cell series is considered to be depicted, represent a "short" weir-type baffles (71) and a "tall" baffle (73) or may represent "tall" baffles (71) with a "short" weir-type baffle (73). A cell gasket joint (72) is depicted. The long baffle (74) serves to separate the froth flowing up into the cover from the de-gassed liquor flowing back down into the cell and is generally about the same height as the "short" weir-type baffles. The long baffle (74) is located above the catholyte compartment baffle (85) shown in FIG. 7 and in FIG. 3; this baffle (85) separates the upflow of froth (i.e., gas and liquor) from the downflow of liquor into the catholyte compartment, thereby obtaining some internal recirculation within each catholyte cell compartment. Above the anolyte ports (28), (27A), and (27B) there is depicted an anolyte cover (52) with a portion cut-away to reveal some of the said anolyte ports and to reveal baffles (63) which are within the cover but which rest solidly on top of frames (20A) and (20B). The relatively small, flow holes (61) at or near the bottom of baffles (63) are also shown; these allow the excess anolyte carried up into the cover (52) in the froth gas-lift to flow back down into the cell it came out of, thereby obtaining some internal recirculation within each anolyte cell compartment. It can be seen that anolyte from upcomer holes (28) in frame (20B) is directed, by the baffles, to downcomer holes (27A) and (27B) of frame (20A). For purposes of illustrating an additional possible embodiment of the invention, there is shown a conduit or pipe (80) which may be positioned between covers (51) and (52) or which may be slightly elevated above such a position. The pipe or conduit (80) may serve either to bring electrolyte to the cell series or to remove cell gases from the series; there are, obviously, many piping arrangements which may be used to carry electrolytes to and from the cell-series and to remove cell gases from the cell-series. The "inverted trough" type of cell covers may, obviously, have rounded tops or other such configuration so long as there is sufficient height of the covers to provide head-space to accomodate collapse of the liquor/gas froth (i.e., for "de-frothing" or "de-gassing") which is likely to be carried into the covers through the upcomer holes, said head-space extending at least slightly above the baffles in the cell cover portion from which gases are to be removed. Preferably, and beneficially, the head-space extends the full length of each cover in order that only one gas exit is needed for the entire cover.

In FIG. 7, opposite the side where catholyte cover (51) is shown, the catholyte cover is not shown, but cross-hatched areas (81) and (82) are indicated to show where a corresponding catholyte cover would be if it were shown. In that catholyte cover area, a cut-away reveals anodes and cathodes mounted on their respective mounting plates in position against ridges (22*a*) and (22*b*) and showing bipolar electrical hook-ups from anodes of frame (20B) to cathodes of frame (20A), the space in which the hook-ups are shown being the catholyte portion (32) of frame (20B) which is served by catholyte port (26A), all substantially as described hereinbefore. The said catholyte portion (32) of frame (20B) also communicates with catholyte within the cathodes of cell (20A) by way of ports in the cathode-plate to which the said cathodes are mounted. Baffle (85) serves to separate the upflow of froth (catholyte and gas) from the downflow of excess catholyte.

It is preferred that the anolyte upflow ports (28) of FIG. 2 have dimensions which provide greater than about 0.004 in.$^2$ of cross-sectional flow of froth per ampere of current capacity and that the down-flow ports (27) have dimensions which provide greater than about 0.002 in.$^2$ of cross-sectional flow of de-gassed anolyte per ampere of current capacity. Also, referring to FIG. 2, it is preferred that catholyte ports (25) and (26) provide essentially about the same catholyte flow capacities as used for the anolyte flow.

The methods and principals of the present invention are applicable in providing cell-to-cell or series-to-series flow of electrolytes in other embodiments of chlor-alkali membrane cells of monopolar or bipolar circuitry and of flat-plate electrode or pocket-electrode designs.

I claim:

1. In a bank or series of chlor-alkali electrolytic cells, wherein each cell comprises at least one electrode pair separated by a cation permselective, substantially hydraulically impermeable membrane, with means for flowing catholyte from cell-to-cell sequentially, the embodiment in which the means for flowing catholyte from cell-to-cell comprises, in operable combination, entry means for adding water or dilute caustic to the catholyte portion of a first cell of the bank or series, flow means for directing gas-lifted catholyte liquor from said first cell to a de-gassing compartment above said cathodes, flow means for directing at least a portion of the de-gassed catholyte to a point below the surface of the catholyte liquor in the next successive cell while allowing at least a portion of the de-gassed catholyte to re-enter the cell from which it came, flow means for directing gas-lifted catholyte liquor from said next successive cell and each additional successive cell in the series thereafter, to a degassing compartment above the cathodes, at least a portion of the de-gassed catholyte of each cell being directed to a next successive cell while allowing at least a portion of the de-gassed catholyte to re-enter the cell from which it came, flow means for directing de-gassed catholyte liquor from the last cell of the bank or series, and flows means for removing cell gasses from the de-gassing compartment.

2. In a bank or series of chlor-alkali electrolytic cells, wherein each cell comprises at least one electrode pair separated by a cation permselective, substantially hydraulically impermeable membrane, with means for flowing anolyte from cell-to-cell sequentially, the embodiment in which the means for flowing anolyte from cell-to-cell comprises, in operable combination, entry means for adding alkali metal chloride solution to the anolyte portion of a first cell of the bank or series, flow means for directing gas-lifted anolyte liquor from said first cell to a de-gassing compartment above said anodes, flow means for directing at least a portion of the de-gassed anolyte to a point below the surface of the anolyte liquor in the next successive cell while allowing at least a portion of the de-gassed anolyte to re-enter the cell from which it came, flow means for directing gas-lifted anolyte liquor from said next successive cell and each additional successive cell in the series thereafter, to a de-gassing compartment above the anodes, at least a portion of the de-gassed anolyte of each cell being directed to a next successive cell while allowing at least a portion of the de-gassed anolyte to re-enter the cell from which it came, flow means for directing de-gassed anolyte liquor from the last cell of the bank or series, and flow means for removing cell gasses from the de-gassing compartments.

3. The embodiment of claim 1 when employed simultaneously with the embodiment of claim 2.

4. The embodiments of claim 1 when employed simultaneously with the embodiments of claim 2 and in which the first cell, with respect to catholyte series flow, is the last cell with respect to anolyte series flow.

5. The embodiment of claim 2 wherein the said alkali metal chloride is NaCl.

6. The embodiments of claims 1 or 2 wherein the flow means for directing gas-lifted catholyte and anolyte, respectively, have dimensions which provide greater than about 0.004 $in^2$ of cross-sectional flow of froth per ampere of current capacity.

7. The embodiments of claims 1 or 2 wherein the flow means for allowing re-entry of de-gassed catholyte and anolyte, respectively, to the cells from which they came, have dimensions which provide greater than about 0.002 $in.^2$ of cross-sectional flow of de-gassed liquor per ampere of current capacity.

8. The embodiments of claims 1 or 2 wherein the electrolytic cells have monopolar electrodes.

9. The embodiments of claims 1 or 2 wherein the electrolytic cells have bipolar electrodes.

10. The embodiments of claims 1 or 2 wherein the electrolytic cells have flat-plate electrodes.

11. The embodiments of claims 1 or 2 wherein the electrolytic cells have pocket electrodes.

12. The embodiments of claims 1 or 2 wherein the number of cells in the bank or series is from 3 to 7.

* * * * *

UNITED STATES PATENT AND TRADEMARK OFFICE

CERTIFICATE OF CORRECTION

PATENT NO. : 4,391,693

DATED : July 5, 1983

INVENTOR(S) : John R. Pimlott

It is certified that error appears in the above—identified patent and that said Letters Patent is hereby corrected as shown below:

Col. 1, line 59, "practioners" should read --practitioners--.

Col. 3, line 52, "relatively" should read --relativity--.

Col. 5, line 3, "of" should read --or--.

Signed and Sealed this

*Twenty-first* Day of *August 1984*

[SEAL]

*Attest:*

GERALD J. MOSSINGHOFF

*Attesting Officer*

*Commissioner of Patents and Trademarks*